US007397453B2

(12) United States Patent
Park

(10) Patent No.: US 7,397,453 B2
(45) Date of Patent: Jul. 8, 2008

(54) LIQUID CRYSTAL DISPLAY DEVICE AND DRIVING METHOD THEREOF

(75) Inventor: Kwang Soon Park, Daegu (KR)

(73) Assignee: LG Display Co., Ltd., Seoul (KR)

( * ) Notice: Subject to any disclaimer, the term of this patent is extended or adjusted under 35 U.S.C. 154(b) by 568 days.

(21) Appl. No.: 11/016,858

(22) Filed: Dec. 21, 2004

(65) Prior Publication Data

US 2005/0225523 A1 Oct. 13, 2005

(30) Foreign Application Priority Data

Apr. 7, 2004 (KR) ..... 10-2004-0023890

(51) Int. Cl.
*G09G 3/36* (2006.01)

(52) U.S. Cl. ..... 345/87; 345/92; 345/94; 345/100; 345/204; 349/41; 349/42

(58) Field of Classification Search ..... 345/87, 345/89, 90–95, 98–100, 204
See application file for complete search history.

(56) References Cited

U.S. PATENT DOCUMENTS

| | | | | |
|---|---|---|---|---|
| 6,097,453 | A * | 8/2000 | Okita | 349/43 |
| 6,476,787 | B1 * | 11/2002 | Libsch et al. | 345/92 |
| 7,113,160 | B2 * | 9/2006 | Kwon et al. | 345/99 |
| 7,116,303 | B2 * | 10/2006 | Park | 345/92 |
| 2004/0196232 | A1 * | 10/2004 | Kim et al. | 345/89 |

* cited by examiner

*Primary Examiner*—Richard Hjerpe
*Assistant Examiner*—Jennifer T Nguyen
(74) *Attorney, Agent, or Firm*—McKenna Long & Aldridge LLP

(57) ABSTRACT

A liquid crystal display device includes: a gate driver for sequentially applying a gate signal to a gate line for a horizontal line; a control signal supplier for applying a clock-shaped control signal to a control line provided in parallel to the gate line for the horizontal line; a data driver for applying a video signal to a data line provided in a direction crossing the gate line; a first liquid crystal cell provided at one side of the data line to receive said video signal under control of said gate signal and said control signal; and a second liquid crystal cell provided at an other side of the data line to receive said video signal under control of said gate signal.

13 Claims, 5 Drawing Sheets

LIQUID CRYSTAL DISPLAY DEVICE AND DRIVING METHOD THEREOF

This application claims the benefit of Korean Patent Application No. P2004-23890 filed in Korea on Apr. 7, 2004, which is hereby incorporated by reference.

BACKGROUND OF THE INVENTION

1. Field of the Invention

This invention relates to a display device, and more particularly to a liquid crystal display device and a driving method thereof.

2. Description of the Related Art

Generally, a liquid crystal display (LCD) controls light transmittance of a liquid crystal using an electric field to thereby display a picture. To this end, the LCD device includes a liquid crystal display panel having a pixel matrix, and a driving circuit for driving the liquid crystal display panel. The driving circuit drives the pixel matrix such that picture information can be displayed on the display panel.

FIG. 1 shows a related art liquid crystal display device. As shown in FIG. 1, the related art LCD device includes a liquid crystal display panel 2, a data driver 4 for driving data lines DL1 to DLm of the liquid crystal display panel 2, and a gate driver 6 for driving gate lines GL1 to GLn of the liquid crystal display panel 2. The liquid crystal display panel 2 includes a thin film transistor TFT at each intersection between the gate lines GL1 to GLn and the data lines DL1 to DLm that define liquid crystal cells arranged in a matrix type. Each of the liquid crystal cells includes a pixel electrode connected to the thin film transistor TFT of a respective liquid crystal cell.

The gate driver 6 sequentially applies a gate signal to each gate line GL1 to GLn in response to a control signal from a timing controller (not shown). The data driver 4 converts data R, G and B from the timing controller into analog video signals to thereby apply video signals to the data lines DL1 to DLm for one of the horizontal lines during every horizontal period when a gate signal is applied to each gate line GL1 to GLn. More particularly, the thin film transistor TFT applies data from the data lines DL1 to DLm to the liquid crystal cell in response to a control signal from the gate lines GL1 to GLn.

The liquid crystal cell can be equivalently expressed as a liquid crystal capacitor Clc because it includes a common electrode and a pixel electrode opposed to each other with a liquid crystal material therebetween. The pixel electrode is connected to the thin film transistor TFT. The liquid crystal cell also includes a storage capacitor (not shown) connected to a pre-stage gate line in order to keep a data voltage charged on the liquid crystal capacitor Clc until the next data voltage is charged therein.

The liquid crystal cells of such a related art LCD device has vertical lines equal to the number (i.e., m) of the data lines DL1 to DLm because they are provided at intersections between the gate lines DL1 to DLn and the data lines DL1 to DLm. In other words, the liquid crystal cells are arranged in a matrix type in such a manner to make m vertical lines and n horizontal lines. The related art LCD device requires m data lines DL1 to DLm so as to drive the liquid crystal cells having m vertical lines. Therefore, the related art LCD device has a drawback in that a number "m" of data lines DL1 to DLm should be provided to drive the liquid crystal display panel 2. Thus, processing time and a manufacturing cost are large. Furthermore, the related art LCD device has a problem in that, since a large number of data drive integrated circuits (IC's) are included in the data driver 4 so as to drive the m data lines DL1 to DLm, a large manufacturing cost is required.

SUMMARY OF THE INVENTION

Accordingly, the present invention is directed to a liquid crystal display device and a driving method thereof that substantially obviates one or more of the problems due to limitations and disadvantages of the related art.

An object of the present invention to provide a liquid crystal display device and a driving method thereof for reducing the number of data lines as well as the number of data drive integrated circuits corresponding thereto.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In order to achieve these and other objects of the invention, a liquid crystal display device includes: a gate driver for sequentially applying a gate signal to a gate line for a horizontal line; a control signal supplier for applying a clock-shaped control signal to a control line provided in parallel to the gate line for the horizontal line; a data driver for applying a video signal to a data line provided in a direction crossing the gate line; a first liquid crystal cell provided at one side of the data line to receive said video signal under control of said gate signal and said control signal; and a second liquid crystal cell provided at an other side of the data line to receive said video signal under control of said gate signal.

In another aspect, a method of driving a liquid crystal display device includes the steps of sequentially applying a gate signal to gate lines provided for each horizontal line; applying a control signal that periodically repeats a high state and a low state said gate signal to control lines provided for each horizontal line; applying a first video signal to first liquid crystal cells located at one side of data lines when said gate signal and said high-state control signal are supplied; and applying a second video signal to second liquid crystal cells located at other side of the data lines when said gate signal and said low-state control signal are supplied.

In another aspect, a liquid crystal display device includes: a control line provided in parallel to the gate line; a data line provided in a direction crossing the gate line; first liquid crystal cell provided at one side of the data line to receive a first video signal under control of said gate signal and said control signal; second liquid crystal cells provided at an other side of the data line to receive a second video signal under control of said gate signal; a first thin film transistor having a gate terminal connected to the gate line and a source terminal connected to the control line; and a second thin film transistor having a gate terminal connected to a drain terminal of the first thin film transistor, a source terminal connected to the data line and a drain terminal connected to the first liquid crystal cell; and a third thin film transistor having a gate terminal connected to the gate line, a source terminal connected to the data line and a drain terminal connected to the second liquid crystal cell.

It is to be understood that both the foregoing general description and the following detailed description are exemplary and explanatory and are intended to provide further explanation of the invention as claimed.

BRIEF DESCRIPTION OF THE DRAWINGS

These and other objects of the invention will be apparent from the following detailed description of the embodiments of the present invention with reference to the accompanying drawings.

DETAILED DESCRIPTION OF THE PREFERRED EMBODIMENTS

Reference will now be made in detail to the preferred embodiments of the present invention, examples of which are illustrated in the accompanying drawings. Hereinafter, the preferred embodiments of the present invention will be described in detail with reference to FIGS. 2 to 5.

Figure 2:
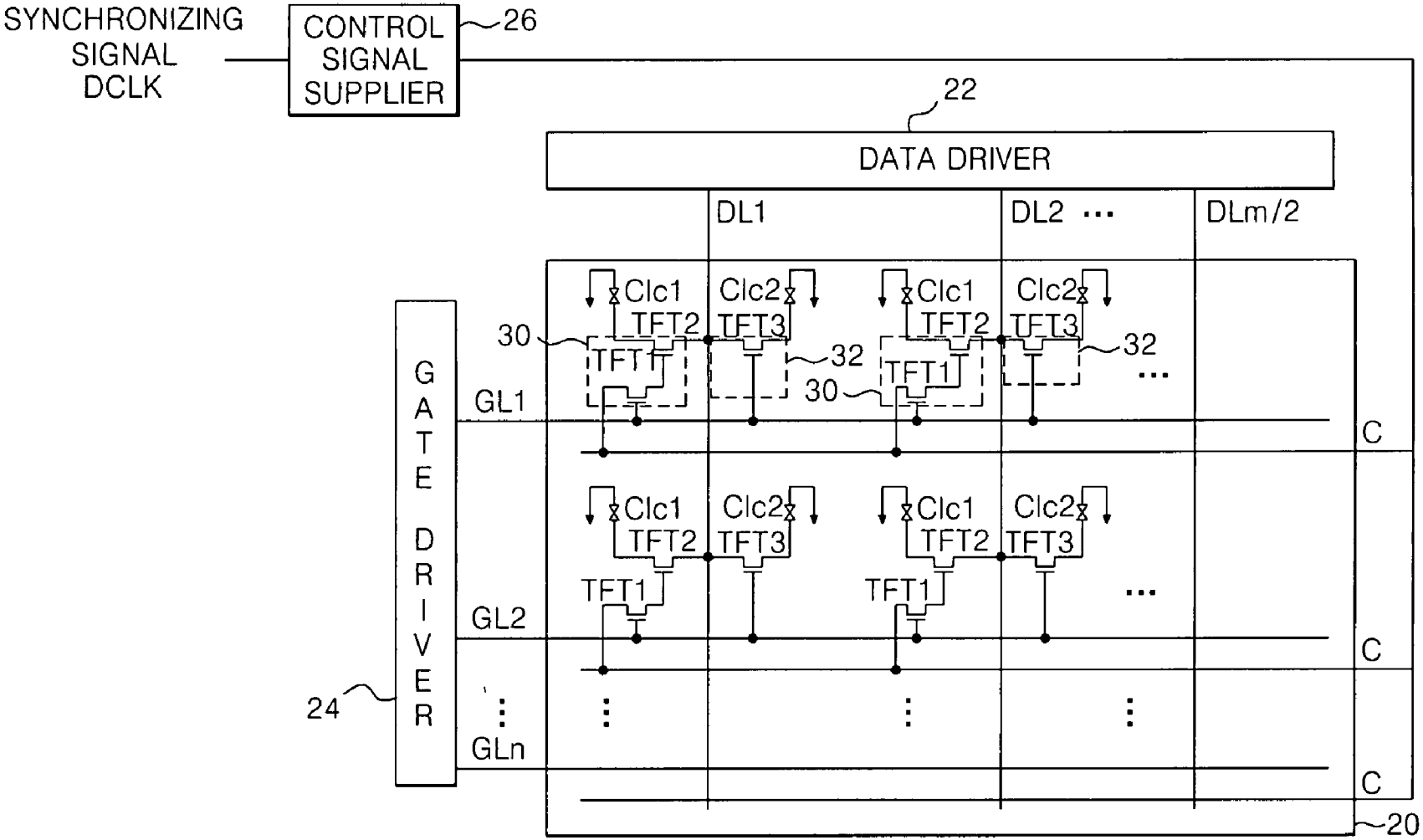
FIG. 2 is a block circuit diagram showing a configuration of a liquid crystal display according to an embodiment of the present invention.

FIG. 2 schematically shows a liquid crystal display (LCD) according to an embodiment of the present invention. As shown in FIG. 2, the LCD device according to an embodiment of the present invention includes a liquid crystal display panel 20, a data driver 22 for driving data lines DL1 to DLm/2 of the liquid crystal display panel 20, a gate driver 24 for driving gate lines GL1 to GLn of the liquid crystal display panel 20, and a control signal supplier 26 for driving control lines C provided in parallel to the gate lines GL1 to GLn. The liquid crystal display panel 20 includes first and second liquid crystal cells Clc1 and Clc2 that are on opposite sides of one of the data lines and between a pair of the gate lines. A first switching part 30 for driving the first liquid crystal cell Clc1 is connected to the data line separating first and second liquid crystal cells Clc1 and Clc2. Further, a second switching part 32 for driving the second liquid crystal cell Clc2 is also connected to the data line separating the first and second liquid crystal cells Clc1 and Clc2.

The first and second liquid crystal cells Clc1 and Clc2 can be equivalently expressed as a pair of liquid crystal capacitors because they both include a common electrode and a pixel electrode opposed to each other with a liquid crystal material therebetween. A first pixel electrode is connected to the first switching part 30 and a second pixel electrode is connected to the second switching part 32. Each of the first and second liquid crystal cells Clc1 and Clc2 can also respectively include a storage capacitor (not shown) connected to the pre-stage gate line (or common electrode) or the control line C in order to keep a voltage of a video signal charged in the liquid crystal capacitor until the next video signal is applied.

Figure 1:
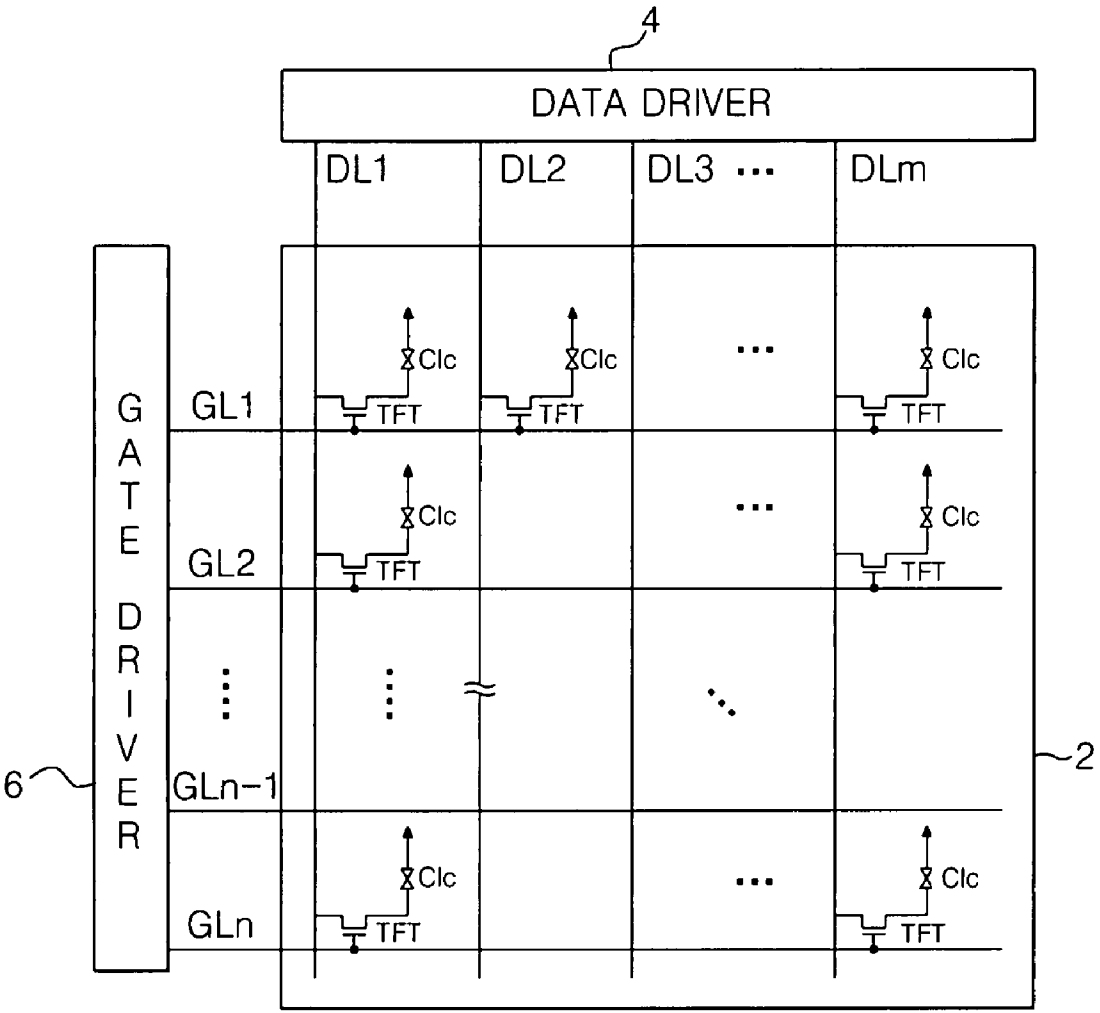
FIG. 1 RELATED ART
FIG. 1 is a block circuit diagram showing a configuration of a related art liquid crystal display.

The first liquid crystal cell Clc1 and the first switching part 30 are provided at the left side of the data line DL, that is, at odd-numbered vertical lines. The second liquid crystal cell Clc2 and the second switching part 32 are provided at the right side of the data line DL, that is, at even-numbered vertical lines. In other words, the first and second liquid crystal cells Clc1 and Clc2 are provided at the left and right sides of a single data line DL that is positioned adjacently therebetween. In this case, the first and second liquid crystal cells Clc1 and Clc2 connected to a single of data line DL receive video signals from the same data line DL to which they are both connected. Accordingly, an LCD device according to an embodiment of the present invention allows the number of data lines DL to be reduced by half as compared to the related art LCD device shown in FIG. 1.

Figure 4:
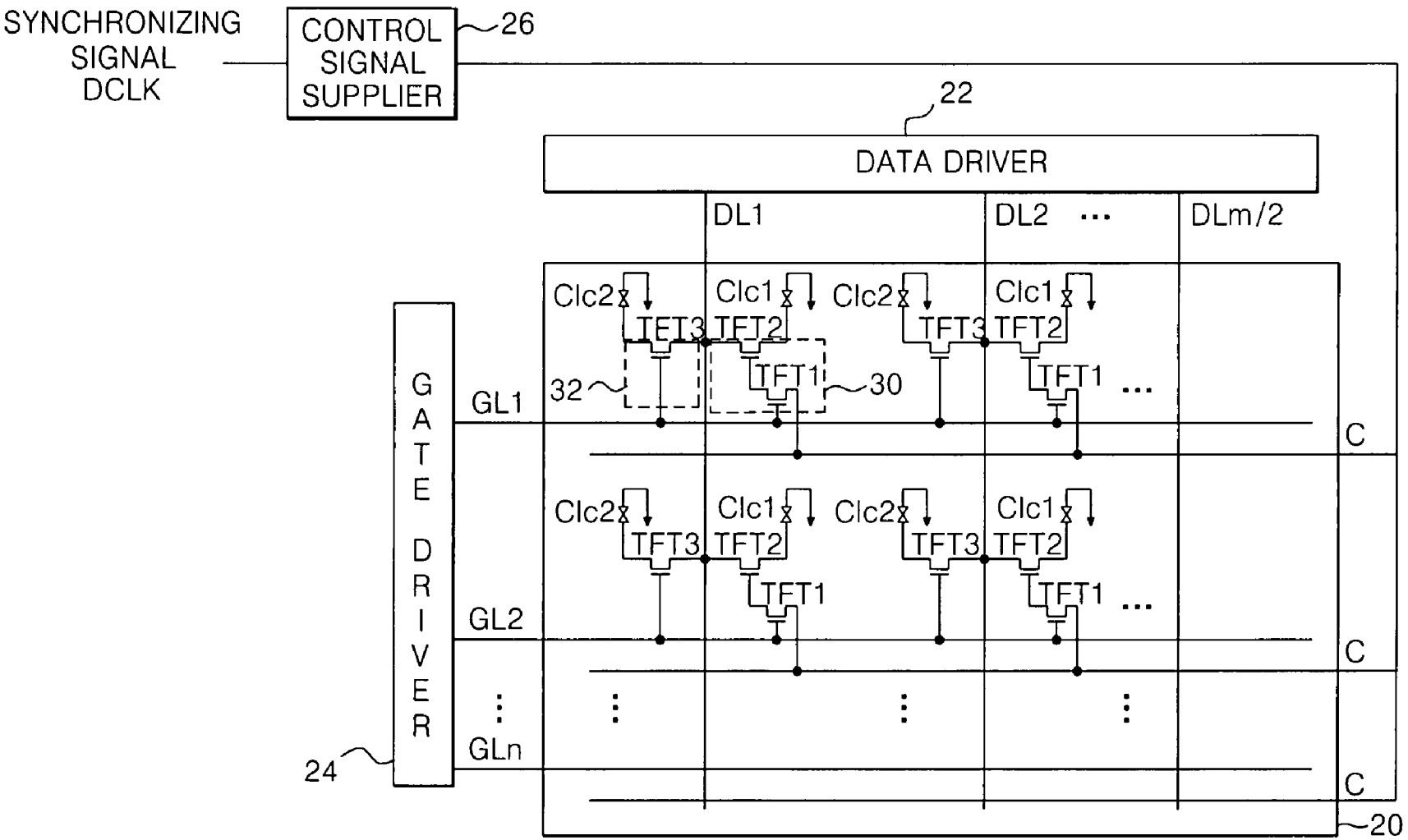
FIG. 4 is a block circuit diagram of a liquid crystal display in which positions of the liquid crystal cells are changed from the liquid crystal display shown in FIG. 2.

Alternatively, embodiments of the present invention can have the positions of the first and second liquid crystal cells Clc1 and Clc2 switched. As shown in FIG. 4, the first liquid crystal cell Clc1 and the first switching part 30 can be provided at the right side of the data line DL while the second liquid crystal cell Clc2 and the second switching part 32 can be provided at the left side of the data line. In other words, the first liquid crystal cell Clc1 and the first switching part 30 can be provided at the even-numbered vertical lines while the second liquid crystal cell Clc2 and the second switching part 32 can be provided at the odd-numbered vertical lines.

As further shown in FIG. 2, a control line C is provided in parallel to the gate line in such a manner as to make a horizontal line. Both of the first and second switching parts 30 and 32 are connected to a gate line GL. The control line C can be provided above or below the gate line GL connected to the first and second switching parts 30 and 32. The first switching part 30 includes first and second thin film transistors TFT1 and TFT2. The first thin film transistor TFT1 is connected to the gate line GL and the control line C. The first thin film transistor TFT1 is turned on when a gate signal is applied to the gate line GL, to apply a high control signal from the control line C to the second thin film transistor TFT2. The second thin film transistor TFT2 is connected to the data line DL and the first thin film transistor TFT1. The second thin film transistor TFT2 is turned on when the high control signal is applied from the first thin film transistor TFT1, to thereby apply a video signal from the data line DL to the first liquid crystal cell Clc1.

The second switching part 32 includes a third thin film transistor TFT3. The third thin film transistor TFT3 is connected to the gate line GL and the data line DL. The third thin film transistor TFT3 is turned on when a gate signal is applied to the gate line GL, to thereby apply a video signal from the data line DL to the second liquid crystal cell Clc2. Thus, a video signal from the data line DL is first applied to the first liquid crystal cell Clc1 and then a same or different video signal is applied to the second liquid crystal cell Clc2.

Figure 3:
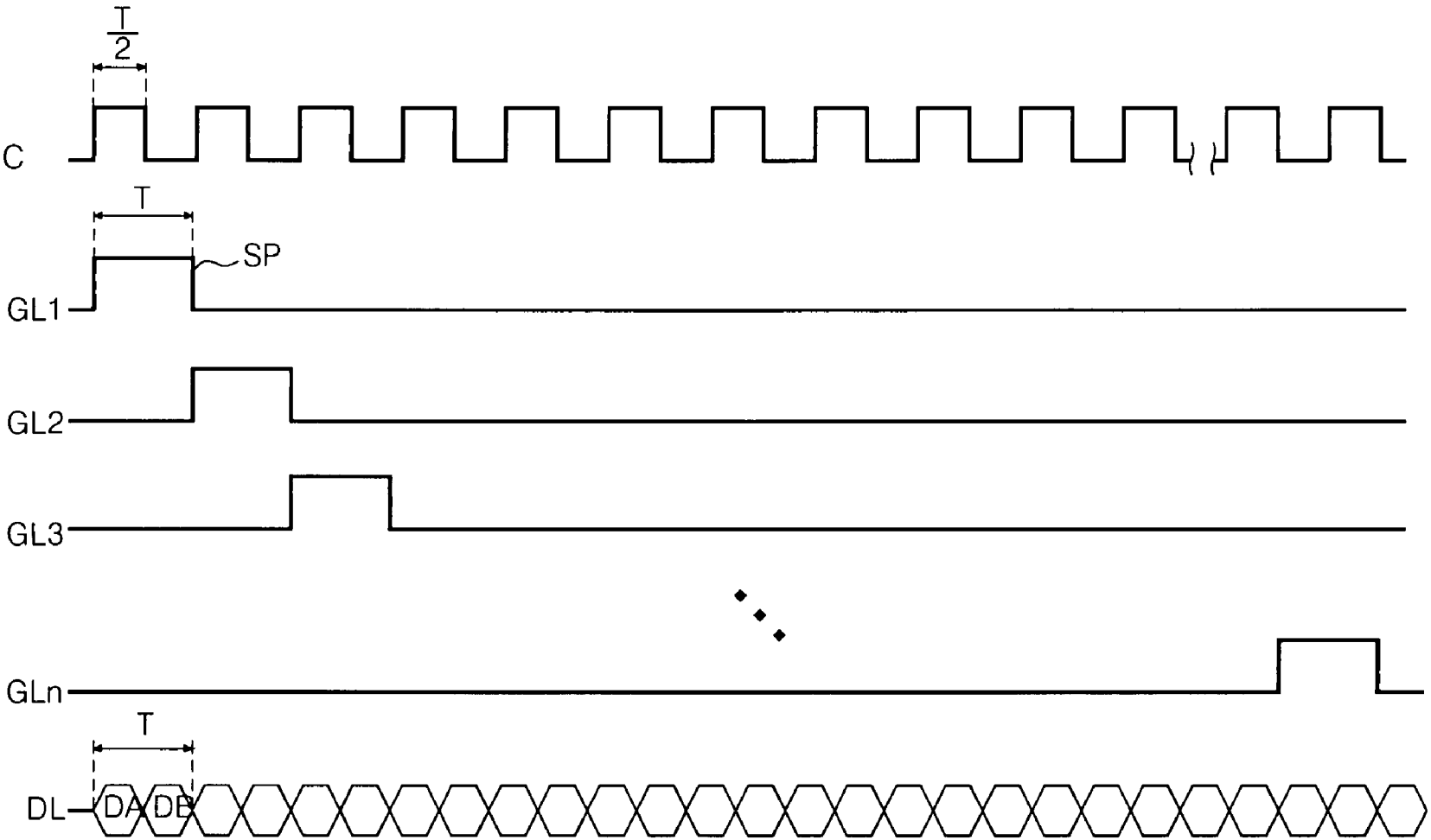
FIG. 3 is a waveform diagram of driving signals applied to the gate line and the control line shown in FIG. 2.

The gate driver 24 sequentially applies a gate signal SP to the gate lines GL1 to GLn, as shown in FIG. 3, in response to a control signal supplied from a timing controller (not shown). The data driver 22 converts R, G and B data from the timing controller into analog video signals and applies converted R, G and B data to the data lines DL1 to DLm/2. Herein, the data driver 22 successively applies two video signals DA and DB to the data lines DL1 to DLm/2 during a time interval T when the gate signal SP is applied. The data driver 22 applies the first video signal DA to the data lines DL1 to DLm/2 during the first-half time interval T/2 when the gate signal SP is applied, and applies the second video signal DB to the data lines DL1 to DLm/2 during the second-half time interval T/2. In an LCD device according to embodiments of the present invention, the number of data lines DL1 to DLm/2 used is reduced by half as compared to the related art LCD device shown in FIG. 1, so that the number of data drive IC's included in the data driver 22 can also be reduced by half.

The control signal supplier 26 generates control signals using a dot clock DCLK and synchronizing signals H and V supplied from the exterior thereof. For instance, the control signal supplier 26 can generate a control signal by making a frequency division of the dot clock DCLK. Further, the control signal supplier 26 can generate a control signal using the horizontal synchronizing signal H. The control signal supplier 26 generates control signals in such a manner to have the same period as the gate signal SP. In other words, the control signal maintains a high state during the first-half time interval T/2 of the gate signal SP (i.e., a high control signal) while maintaining a low state during the second-half time interval T/2 thereof (i.e., a low control signal). Hereinafter, a procedure of supplying video signals to the first and second liquid crystal cells Clc1 and Clc2 will be described in detail with reference to FIG. 3.

First, the gate driver 24 sequentially applies the gate signal SP to the gate lines GL1 to GLn. The gate signal supplier 26 applies a control signal having the same period as the gate signal SP to the control lines C. If the gate signal SP is applied to the gate line GL, then the first and third thin film transistors TFT1 and TFT3 are turned on.

As the first thin film transistor TFT1 is turned on, a high control signal supplied to the control line C is applied to the gate terminal of the second thin film transistor TFT2 to thereby turn on the second thin film transistor TFT2. As the second thin film transistor TFT2 is turned on, the first video signal DA supplied to the data line DL is applied to the first liquid crystal cell Clc1.

After the first video signal DA is applied to the first liquid crystal cell Clc1, a low control signal is applied to the control line C (i.e., during the second-half time interval T/2 of the gate signal SP). As the low control signal is applied to the control line C, the second thin film transistor TFT2 is turned off. Meanwhile, the third thin film transistor TFT3 is kept in a turn-on state by the gate signal SP. Thus, the second video signal DB supplied to the data line DL is applied to the second liquid crystal cell Clc2.

The LCD device according to embodiments of the present invention applies a desired video signal to the first liquid crystal cell Clc1 when a high control signal is supplied while applying a desired video signal to the second liquid crystal cell Clc2 when a low control signal is supplied. Such a LCD device according to embodiments of the present invention can apply desired video signals to the first and second liquid crystal cells Clc1 and Clc2 using a single data line DL, so that the number of data lines DL and the number of data driving IC's can be reduced. Such reductions lower manufacturing costs of an LCD device.

In the LCD device according to one embodiment of the present invention shown in FIG. 2, an undesired first video signal DA is applied to the second liquid crystal cell Clc2 because the third thin film transistor TFT3 keeps a turn-on state during a time interval when the gate signal SP is supplied. But, the second video signal DB following the first video signal DA is applied to the second liquid crystal cell Clc2, so that it becomes possible to generate a light having a desired brightness. However, the liquid crystal display panel 20 according to the embodiment of the present invention shown in FIG. 2 is liable to have a non-uniform picture quality for each line. More specifically, the first switching part 30 for driving the first liquid crystal cell Clc1 includes two thin film transistors TFT1 and TFT2 while the second switching part 32 for driving the second liquid crystal cell Clc2 includes a single thin film transistor T3. Thus, since an aperture ratio of the vertical line provided with the first switching part 30 is different from that of the vertical line provided with the second switching part 32, a non-uniform picture is liable to be displayed for each line.

Figure 5:
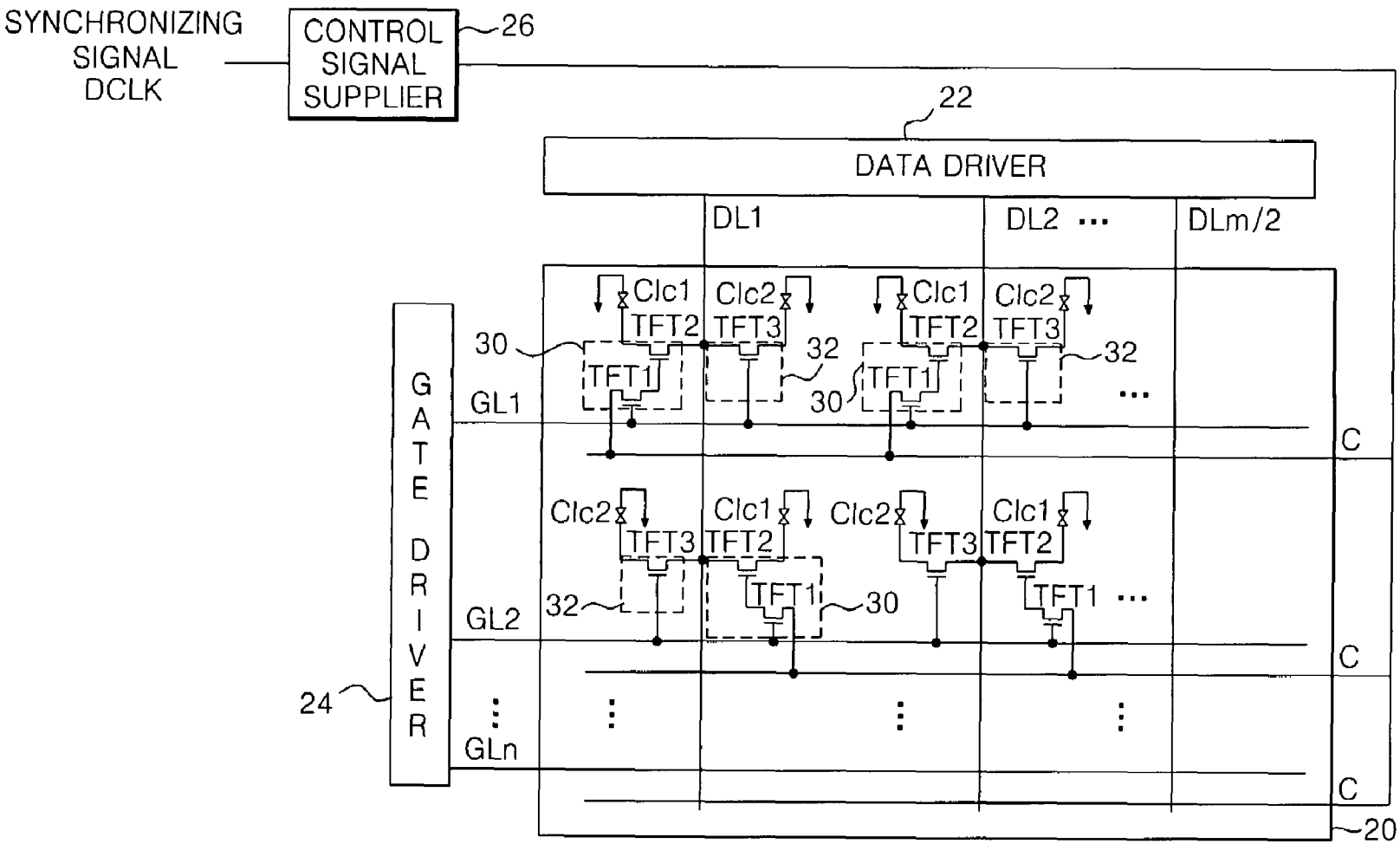
FIG. 5 is a block circuit diagram showing a configuration of a liquid crystal display according to another embodiment of the present invention.

FIG. 5 is a block circuit diagram showing a configuration of a liquid crystal display according to another embodiment of the present invention. In order to prevent a non-uniform picture, an LCD device according to another embodiment of the present invention has first and second liquid crystal cells Clc1 and Clc2 arranged in a zigzag fashion along the data line DL, as shown in FIG. 5. If the first and second liquid crystal cells Clc1 and Clc2 are arranged in a zigzag fashion along the data line DL, then the first and second switching parts 30 and 32 also are arranged in a zigzag fashion along the data line DL.

As the first and second switching parts 30 and 32 are alternately arranged in a zigzag fashion along the data line DL for each horizontal line, a different aperture ratio between the first switching part 30 and the second switching part 32 can be compensated to display an image having a uniform picture quality on the liquid crystal display panel 20.

As described above, according to embodiments of the present invention, the gate line and the control line are provided for each horizontal line and a control signal having the same period as the gate signal is applied to the gate line, thereby driving the liquid crystal cells positioned at the left and right sides of a data line. Accordingly, the LCD device according to embodiments of the present invention can reduce the number of data lines and the number of data driving IC's corresponding thereto by half as compared to the related art LCD device and hence can reduce the manufacturing cost. Furthermore, the LCD device according to embodiments of the present invention has an advantage in that, as the liquid crystal cell receiving the video signal is determined in response to the control signal supplied to the control line, it becomes possible to identically keep the structure of the gate driver. Moreover, the liquid crystal cells provided at the left and right sides of the data line are accessed in a zigzag fashion along each data line, thereby displaying an image having a uniform picture quality on the liquid crystal display panel.

It will be apparent to those skilled in the art that various modifications and variations can be made in the the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a gate driver applying gate signals to a plurality of gate lines, respectively;

a control signal supplier applying a clock-shaped common control signal to a plurality of control lines in parallel to the gate lines in common, wherein the plurality of control lines are connected with each other;

a data driver applying video signals to a plurality of data lines crossing the gate lines, respectively;

a plurality of first liquid crystal cells provided at one side of the data lines;

a plurality of second liquid crystal cells provided at an other side of the data lines;

a first cell driver provided for each of the first liquid crystal cells, wherein the first cell driver supplies a first video signal from a data line under control of a gate signal and the common control signal; and a second cell driver provided for each of the second liquid crystal cells, wherein the second cell driver supplies a second video signal from the data line under control of the gate signal.

2. The liquid crystal display device according to claim 1, wherein the common control signal maintains a high state during a first-half time interval of said gate signal while maintaining a low state during a second-half time interval of said gate signal.

3. The liquid crystal display device according to claim 2, wherein the first cell driver supplies the first video signal to the first liquid crystal cell when the gate signal and the common control signal are high-state.

4. The liquid crystal display device according to claim 3, wherein the second cell driver supplies the second video signal to the second liquid crystal cell when the gate signal is high-state and the common control signal is low-state.

5. The liquid crystal display device according to claim 2, wherein the data driver applies the first video signal to be supplied to the first liquid crystal cell during a first-half time interval of said gate signal while applying the second video signal to be supplied to the second liquid crystal cell during a second-half time interval of said gate signal.

6. The liquid crystal display device according to claim 1, wherein the first cell driver includes:

a first thin film transistor having a gate terminal connected to the gate line and a source terminal connected to one of the control lines; and a second thin film transistor having a gate terminal connected to a drain terminal of the first thin film transistor, a source terminal connected to the data line and a drain terminal connected to the corresponding first liquid crystal cell.

7. The liquid crystal display device according to claim 1, wherein the second cell driver includes:

a thin film transistor having a gate terminal connected to the gate line, a source terminal connected to the data line and a drain terminal connected to the second liquid crystal cell.

8. The liquid crystal display device according to claim 1, wherein the plurality of the first liquid crystal cells and the plurality of the second liquid crystal cells are alternately arranged with respect to the data line for each horizontal line in the liquid crystal display device.

9. A method of driving a liquid crystal display device, comprising the steps of:

sequentially applying a gate signal to gate lines provided for each horizontal line;

applying a common control signal that periodically repeats a high state and a low state to a plurality of control lines in common;

applying a first video signal to first liquid crystal cells located at one side of data lines when said gate signal and said high-state control signal are supplied; and applying a second video signal to second liquid crystal cells located at other side of the data lines when said gate signal and said low-state control signal are supplied.

10. The method according to claim 9, wherein each of the first and second liquid crystal cells are positioned adjacently to each other with one of the data lines therebetween that provides the first and second video signals.

11. The method according to claim 9, wherein the first video signal is different than the second video signal.

12. A liquid crystal display device, comprising:

a plurality of gate lines for carrying gate signals, respectively;

a plurality of control lines provided in parallel to the gate lines, wherein the control lines are connected with each other and supplies a common control signal;

a plurality of data lines crossing the gate lines;

first liquid crystal cells provided at one side of the data lines to receive a first video signal under control of a gate signal and the common control signal;

second liquid crystal cells provided at an other side of the data lines to receive a second video signal under control of the gate signal;

a first cell driver provided for each of the first liquid crystal cells;

a second cell driver provided for each of the second liquid crystal cells; and wherein the first cell driver includes:

a first thin film transistor supplies the common control signal from one of the control lines under control of one the gate lines a second thin film transistor supplies a first video signal from a data line to the first liquid crystal cell under control of common control signal from the first thin film transistor, and further wherein the second first cell driver includes a third thin film transistor supplies a second video signal from the data line under control of the gate signal from the gate line.

13. The liquid crystal display device according to claim 12, wherein the plurality of the first liquid crystal cells and the plurality of the second liquid crystal cells are arranged with respect to the data line for each horizontal line in the liquid crystal display device.

* * * * *